US008755728B2

(12) United States Patent
Egusa et al.

(10) Patent No.: US 8,755,728 B2
(45) Date of Patent: Jun. 17, 2014

(54) FIXING DEVICE AND IMAGE FORMING APPARATUS INCLUDING A SWITCHING UNIT FOR SWITCHING A STATE OF THE FIXING DEVICE

(75) Inventors: Naoyuki Egusa, Kanagawa (JP); Makoto Furuki, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 180 days.

(21) Appl. No.: 13/365,923

(22) Filed: Feb. 3, 2012

(65) Prior Publication Data

US 2013/0045018 A1 Feb. 21, 2013

(30) Foreign Application Priority Data

Aug. 18, 2011 (JP) ..... 2011-179150

(51) Int. Cl.
*G03G 15/20* (2006.01)

(52) U.S. Cl.
USPC ..... 399/336

(58) Field of Classification Search
USPC ..... 399/336
See application file for complete search history.

(56) References Cited

U.S. PATENT DOCUMENTS

| | | | | |
|---|---|---|---|---|
| 7,035,556 | B2 * | 4/2006 | Behnke et al. | 399/33 |
| 2008/0181684 | A1 * | 7/2008 | Hamaba et al. | 399/322 |
| 2009/0310987 | A1 * | 12/2009 | Taubenberger et al. | 399/33 |

FOREIGN PATENT DOCUMENTS

| | | | |
|---|---|---|---|
| JP | 2004-114580 | A | 4/2004 |
| JP | 2007-316111 | A | 12/2007 |

* cited by examiner

*Primary Examiner* — G. M. Hyder
(74) *Attorney, Agent, or Firm* — Sughrue Mion, PLLC

(57) ABSTRACT

A fixing device includes a fixing unit and a switching unit. The fixing unit includes an emitting unit that emits light and a housing that houses the emitting unit. The fixing unit fixes a toner image to a recording medium by emitting the light to a surface of the recording medium, the recording medium having the toner image formed thereon and having been transported to a predetermined fixing position that is away from the housing. The switching unit switches a state of the fixing device from a first state in which the housing and the recording medium are positioned away from each other to a second state in which the surface of the recording medium at the fixing position is sealed with the housing.

20 Claims, 8 Drawing Sheets

FIXING DEVICE AND IMAGE FORMING APPARATUS INCLUDING A SWITCHING UNIT FOR SWITCHING A STATE OF THE FIXING DEVICE

CROSS-REFERENCE TO RELATED APPLICATIONS

This application is based on and claims priority under 35 USC 119 from Japanese Patent Application No. 2011-179150 filed Aug. 18, 2011.

BACKGROUND

1. Technical Field

The present invention relates to a fixing device and an image forming apparatus.

2. Summary

According to an aspect of the invention, there is provided a fixing device that includes a fixing unit and a switching unit. The fixing unit includes an emitting unit that emits light and a housing that houses the emitting unit. The fixing unit fixes a toner image to a recording medium by emitting the light to a surface of a recording medium, the recording medium having a toner image formed thereon and having been transported to a predetermined fixing position that is away from the housing. The switching unit switches a state of the fixing device from a first state in which the housing and the recording medium are positioned away from each other to a second state in which the surface of the recording medium at the fixing position is covered with the housing.

BRIEF DESCRIPTION OF THE DRAWINGS

Exemplary embodiments of the present invention will be described in detail with reference to the following figures, wherein.

DETAILED DESCRIPTION

Outline

A fixing device according to exemplary embodiments of the invention emits light, such as a flashlight or a laser beam, to a recording medium, such as a paper sheet, that has a toner image formed thereon, and thus the fixing device fixes the toner image to the recording medium. In the case where a recording medium is jammed while being transferred, part of the recording medium that remains, without being transferred, at a position to which the fixing device emits light may be excessively heated and catch fire. The fixing device according to the exemplary embodiments prevents the fire from expanding. An image forming apparatus including the fixing device according to the exemplary embodiments of the invention will be described below.

First Exemplary Embodiment

Configuration

Figure 1:
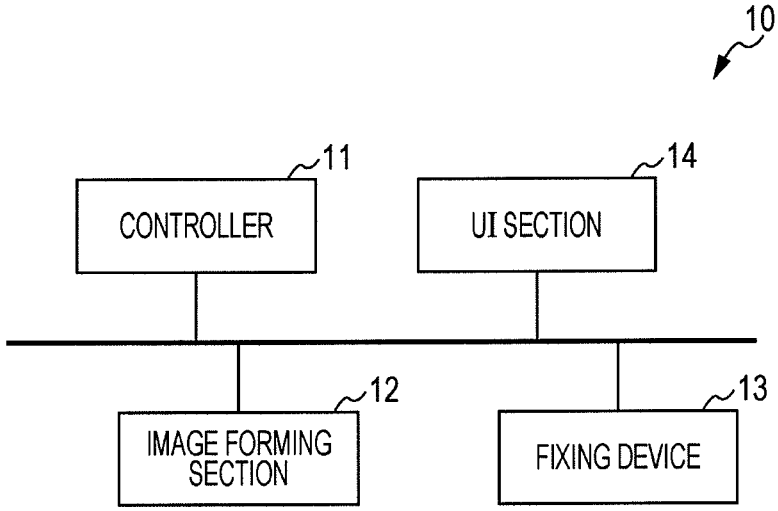
FIG. 1 is a block diagram illustrating a configuration of an image forming apparatus according to a first exemplary embodiment.

FIG. 1 illustrates a configuration example of an image forming apparatus 10 according to the first exemplary embodiment. The image forming apparatus 10 forms an image on, for example, a recording medium (referred to as continuous paper below) that continues in the longitudinal direction and is perforated at intervals of a predetermined length in the longitudinal direction, by electrophotography. Here, the recording medium is an example of a recording medium according to the invention. The image forming apparatus 10 includes a controller 11, an image forming section 12, a fixing device 13, and a user interface (UI) section 14.

The controller 11 includes a central processing unit (CPU) and a memory that includes a read only memory (ROM) and a random access memory (RAM). The CPU executes a control program stored in the ROM and thus controls components connected to the controller 11. Specifically, the controller 11 performs transporting control to transport the continuous paper to the image forming section 12 and the fixing device 13. The controller 11 also causes the image forming section 12 to perform an image forming process in which a toner image based on image data designated by a user through the UI section 14 is formed on the continuous paper. The controller 11 also causes the fixing device 13 to perform processes, such as, to fix the toner image to the continuous paper that has been subjected to the image forming process.

Figure 2:
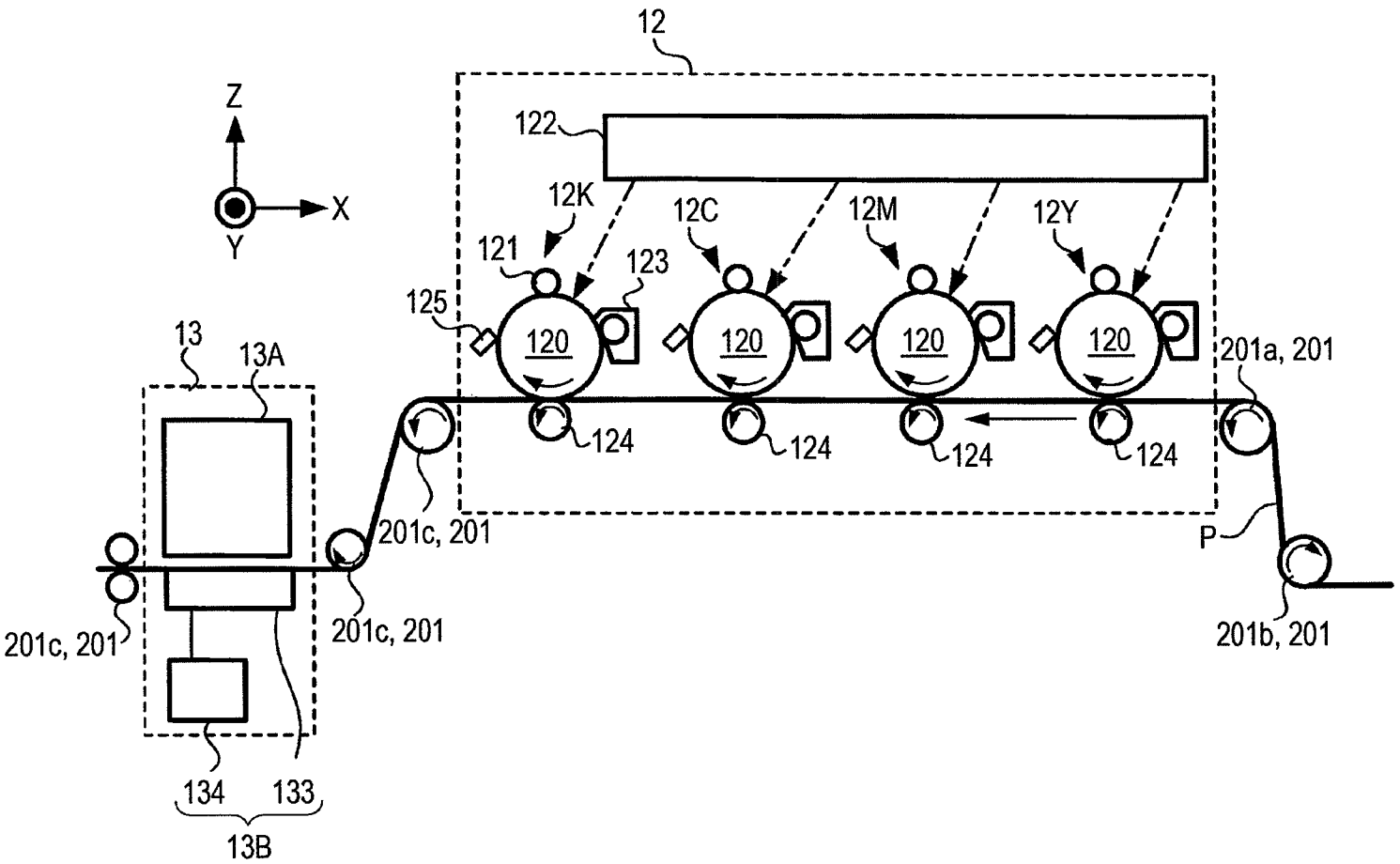
FIG. 2 is a schematic diagram illustrating a configuration of the image forming apparatus according to the first exemplary embodiment.

The image forming section 12 is an example of an image forming section according to the invention. Under control of the controller 11, the image forming section 12 performs an image forming process in which the toner image based on the designated image data is formed on the continuous paper that has been transported to the image forming section 12. FIG. 2 illustrates a configuration of the image forming section 12. FIG. 2 is a schematic diagram illustrating the image forming apparatus 10 according to this exemplary embodiment. Referring to FIG. 2, the image forming apparatus 10 includes multiple rollers 201 (201*a*, 201*b*, and 201*c*) that transport a continuous paper P wound around the rollers 201. Under control of the controller 11, the roller 201*a* transports the continuous paper P fed from a paper feed source to image forming units 12Y, 12M, 12C, and 12K, which will be described below, by rotating in an arrow direction illustrated in FIG. 2. The roller 201*b* is disposed on a side that is further upstream than the roller 201*a* in a transporting direction of the continuous paper P. Under the control of the controller 11, the roller 201*b* applies a force to the continuous paper P in a direction that is opposite to the transporting direction of the continuous paper P, by rotating in the arrow direction illustrated in FIG. 2. The rollers 201*c* are rotated by the transportation of the continuous paper P. The image forming apparatus 10 also includes rollers (not illustrated) on a side that is further downstream than the fixing device 13. The rollers that are not illustrated transport the continuous paper P that has been subjected to a fixing process to the outside of the image forming apparatus 10. The continuous paper P is transported in the arrow direction (in the negative X axis direction in FIG. 2) while having tension applied thereto by the rotation of the rollers that are not illustrated. The image forming section 12 forms a color image on the continuous paper P by use of the image forming units 12Y, 12M, 12C, and 12K that include photoconductors 120 for corresponding colors (yellow (Y), magenta (M), cyan (C), and black (K)). Since the image forming units 12Y, 12M, 12C, and 12K have similar configurations, the image forming unit 12K is taken as an example to describe the detailed configuration of the image forming units 12Y, 12M, 12C, and 12K.

The image forming unit 12K includes a photoconductor 120, a charging device 121, an exposure device 122, a developing device 123, a transferring device 124, and a cleaning device 125. The photoconductor 120 is formed of a cylindrical part having a photoconductive layer formed on the surface. The photoconductor 120 holds an electrostatic latent image that is formed when the surface is exposed. The photoconductor 120 is rotated in the arrow direction illustrated in FIG. 2 around an axis (the Y axis direction) of the photoconductor 120 by driving of a motor that is not illustrated. The charging device 121 includes a charging roller that is disposed so as to be in contact with the surface of the photoconductor 120 and that is rotated by the rotation of the photoconductor 120. The charging device 121 charges the surface of the photoconductor 120 to a certain potential by causing a voltage applying section, which is not illustrated, to apply a voltage to the charging roll. The exposure device 122 exposes the surface of the photoconductor 120 with light in accordance with image data and thus forms an electrostatic latent image on the surface of the photoconductor 120. The developing device 123 develops the electrostatic latent image formed on the surface of the photoconductor 120 by using toner as a developer. The transferring device 124 includes a transfer roller that is disposed so as to be in contact with the photoconductor 120. The transferring device 124 transfers the toner image formed on the surface of the photoconductor 120 to the continuous paper P by causing a voltage applying section, which is not illustrated, to apply a transferring voltage to the transfer roll. The cleaning device 125 is disposed so as to be pressed against the surface of the photoconductor 120 and thus removes the toner that remains on the surface of the photoconductor 120 without being transferred.

The fixing device 13 will be described now. As illustrated in FIG. 2, the fixing device 13 includes a fixing member 13A and a moving mechanism 13B. The fixing member 13A fixes a toner image to the continuous paper P by emitting light to the continuous paper P that has the toner image formed thereon by the image forming section 12. The moving mechanism 13B changes the position of the continuous paper P in accordance with a command from the controller 11.

Figure 3A:
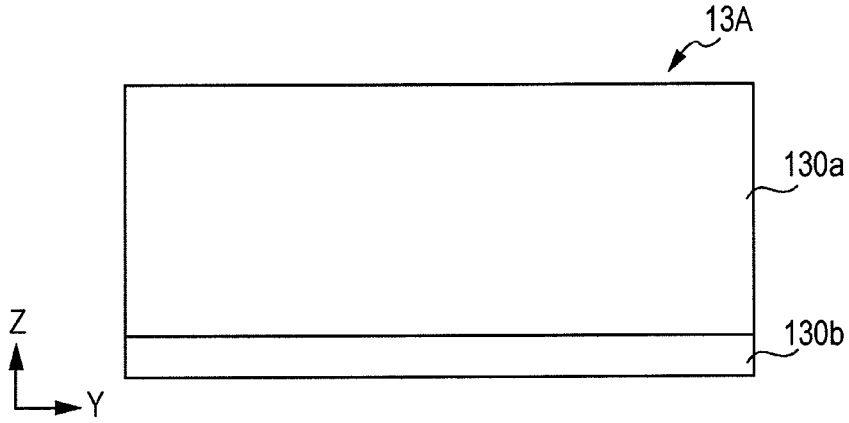
FIGS. 3A and 3B illustrate external views of a fixing member according to the first exemplary embodiment.
Figure 3B:
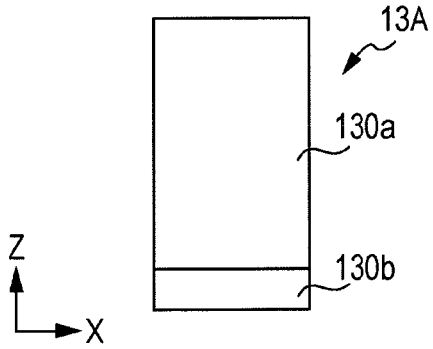
Figure 3C:
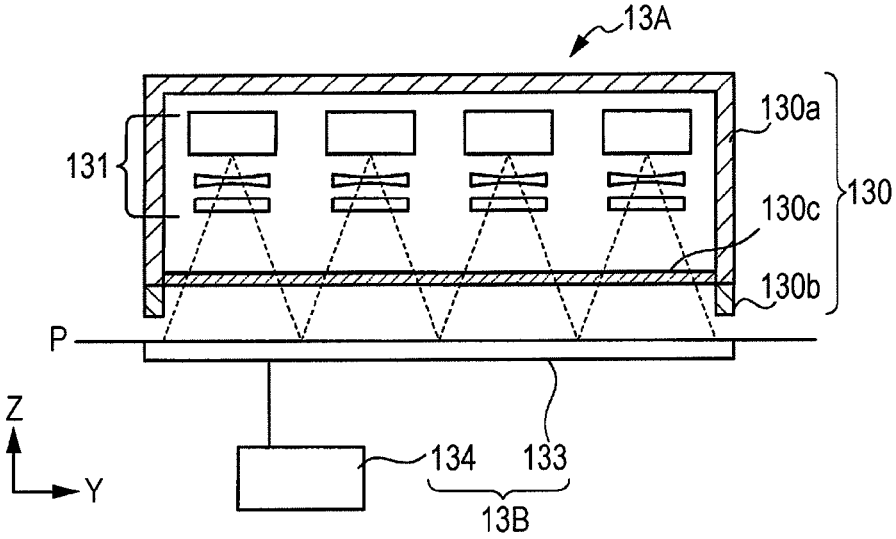
FIG. 3C is a schematic sectional view of the fixing member illustrated in FIG. 3A.

FIGS. 3A and 3B illustrate external views of the fixing member 13A according to the first exemplary embodiment. FIG. 3A illustrates the fixing member 13A when seen in the X axis direction of FIG. 2 (in the transport direction of the continuous paper P). FIG. 3B illustrates the fixing member 13A when seen in the Y axis direction of FIG. 2. FIG. 3C is a schematic sectional view of the fixing member 13A illustrated in FIG. 3A. As illustrated in FIGS. 3A, 3B, and 3C, the fixing member 13A includes a housing 130 that includes an upper housing 130*a* and a lower housing 130*b*. The upper housing 130*a* and the lower housing 130*b* are made of a material such as a metal that is resistant to heat from a laser beam. The lower housing 130*b* has a frame shape and is attached to a lower end portion of the upper housing 130*a* excluding a portion corresponding to apertures. A member 130*c* made of a material such as a glass that allows a laser beam to pass therethrough is disposed inside the housing 130 at an internal lower end of the upper housing 130*a*. Emitting members 131 that emit laser beams are supported above the member 130*c*. Here, the member 130*c* is an example of a partition member according to the invention.

The emitting members 131 are examples of an emitting unit according to the invention. The emitting members 131 each include a laser beam source and optical members. The laser beam source includes multiple laser-beam generating elements that are arranged in the width direction of the continuous paper P (the Y axis direction). The optical member collimates laser beams (indicated by dotted lines in FIG. 3C) emitted from the laser beam source and condenses the laser beams so that the laser beams are focused on a surface of the transported continuous paper P (the surface facing the emitting members 131). In this exemplary embodiment, the multiple emitting members 131 are arranged side by side in the housing 130 so that the overall width of the continuous paper P is irradiated with laser beams that have passed through the member 130*c*. Hereinbelow, the position of the continuous paper P at which laser beams are focused on the surface of the continuous paper P that is being transported is referred to as the fixing position. The fixing device 13 emits laser beams from the emitting members 131 or stops emitting the laser beams in accordance with the transporting control of the controller 11. When the continuous paper P having a toner image formed thereon is transported to the fixing position, the fixing device 13 emits laser beams to melt the toner, and thus the toner is fixed to the continuous paper P.

The moving mechanism 13B will be described now. The moving mechanism 13B includes a plate-like member 133 and a driving section 134. The plate-like member 133 has a size that is equivalent to the size of a lower surface of the housing 130 of the fixing member 13A. The driving section 134 supports the plate-like member 133 and vertically moves the plate-like member 133. The plate-like member 133 is an example of a movable member according to the invention. The plate-like member 133 is supported on the back surface side of the continuous paper P that is at the fixing position in such a manner as to face the housing 130. For example, the driving section 134 includes a motor such as a stepping motor and a ball screw. The driving section 134 rotates a screw shaft of the ball screw by driving the stepping motor and thus moves the plate-like member 133 connected to a nut of the ball screw toward the fixing member 13A (in the Z axis direction in FIG. 3C) to a position that is a predetermined distance away from the fixing position. The driving section 134 may move the plate-like member 133 by driving a stepping motor to rotate an eccentric cam that is in contact with the plate-like member 133. Alternatively, the driving section 134 may be an electronic actuator.

In response to a command from the controller 11, the fixing device 13 performs a movement control process. In the movement control process, the driving section 134 moves the plate-like member 133 toward the fixing member 13A such that the continuous paper P at the fixing position is covered with the housing 130 of the fixing member 13A. Thus, the continuous paper P is nipped between the plate-like member 133 of the moving mechanism 13B and the housing 130 of the fixing member 13A.

Hereinbelow, the state of the fixing device 13 in which the plate-like member 133 is supported such that the continuous paper P is positioned at the fixing position will be referred to as the first state. In addition, the state of the fixing device 13 in which the continuous paper P is nipped between the plate-like member 133 of the moving mechanism 13B and the housing 130 of the fixing member 13A and thus the continuous paper P is covered with the housing 130 of the fixing member 13A will be referred to as the second state.

The configurations of the image forming section 12 and the fixing device 13 have been described above. Referring back to FIG. 1, description for other components will now be given. The UI section 14 includes a touch panel and keys. The UI section 14 sends the controller 11 operation signals representing contents of user's operations made on the touch panel and the keys. The UI section 14 displays a designated image on the touch panel under the control of the controller 11.

Figure 4:
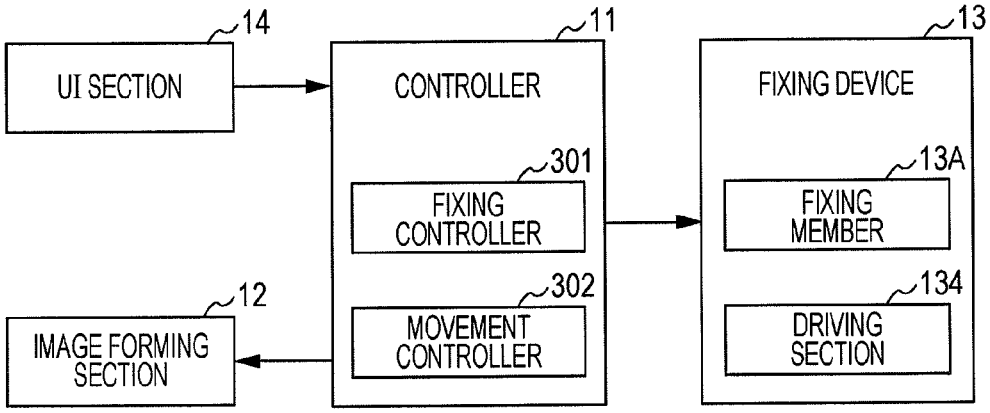
FIG. 4 is a diagram illustrating a relationship between functional blocks of the controller and other components according to the first exemplary embodiment.

Functions of the controller 11 will be described below. FIG. 4 is a functional block diagram illustrating a fixing process and a movement control process of the controller 11. As illustrated in FIG. 4, the controller 11 includes a fixing controller 301 and a movement controller 302. The fixing controller 301 performs a fixing process in which the fixing device 13 fixes the toner image to the continuous paper P by emitting laser beams to the continuous paper P that has been transported to the fixing position. In response to a user's operation performed on the UI section 14, the movement controller 302 drives the moving mechanism 13B of the fixing device 13 and thus switches the state of the fixing device 13 from the first state to the second state. The fixing member 13A and the fixing controller 301 cooperatively function as a fixing unit according to the invention. The movement controller 302 and the driving section 134 cooperatively function as a switching unit according to the invention. The fixing device 13 and the controller 11 cooperatively function as a fixing device according to the invention.

Operation Example

Figure 5:
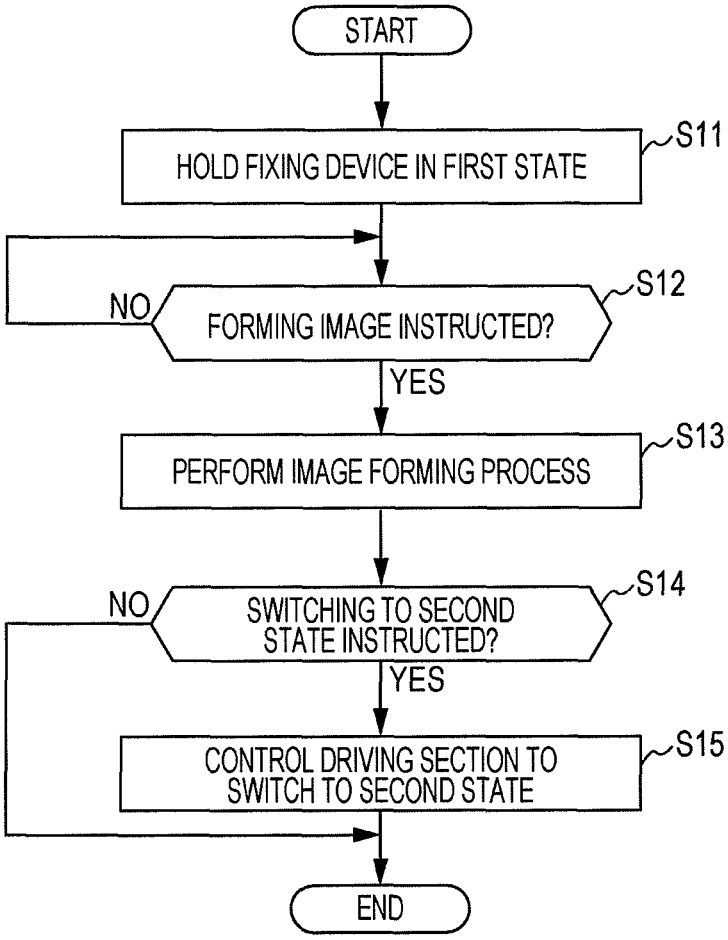
FIG. 5 illustrates an operational flow of the image forming apparatus according to the first exemplary embodiment.
Figure 6A:
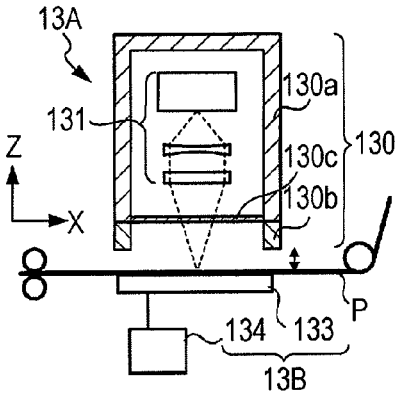
FIGS. 6A and 6B illustrate a first state and a second state of the fixing device according to the first exemplary embodiment.

Operations of the image forming apparatus 10 according to the exemplary embodiment will be described below. FIG. 5 illustrates an operational flow of the image forming apparatus 10. The controller 11 of the image forming apparatus 10 sends the fixing device 13 a signal indicating the first state. Thus, the controller 11 causes the driving section 134 of the moving mechanism 13B to hold the plate-like member 133 of the moving mechanism 13B in the first state illustrated in FIG. 6A so that the continuous paper P is positioned at the fixing position (Step S11). Then, when a user gives an instruction to perform an image forming process via the UI section 14 (YES in Step S12), the controller 11 drives the rollers 201 to start transporting the continuous paper P and causes the image forming section 12 to generate a toner image based on the designated image data to thus form an image on the continuous paper P. The controller 11 causes the fixing member 13A of the fixing device 13 to emit laser beams to the transported continuous paper P and to thus fix the toner image to the continuous paper P (Step S13). The continuous paper P having the toner image fixed thereto is transported to a postprocessing device that is not illustrated. The postprocessing device cuts the continuous paper P along the perforation that has been formed in the continuous paper P in advance.

Figure 6B:
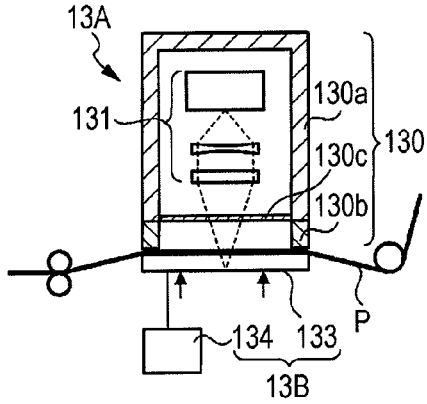

The image forming section 12 forms a toner image on the continuous paper P and the fixing device 13 fixes the toner image on the continuous paper P while the continuous paper P is being transported. In the case, for example, where the continuous paper P becomes jammed or experience another problem, the continuous paper P may catch fire in the fixing device 13, and the fire may spread. In this case, according to the exemplary embodiment, a user performs an operation to switch the state of the fixing device 13 to the second state via the UI section 14. When the controller 11 receives a command to perform switching to the second state via the UI section 14 (YES in Step S14), a signal indicating the second state is sent to the fixing device 13. Then, the driving section 134 of the moving mechanism 13B performs switching to the second state illustrated in FIG. 6B (Step S15). The driving section 134 moves the plate-like member 133 toward the fixing member 13A by a predetermined distance until the continuous paper P at the fixing position is nipped between the plate-like member 133 and the housing 130. When, as illustrated in FIG. 6B, the continuous paper P is nipped by the housing 130 of the fixing member 13A and the plate-like member 133 of the moving mechanism 13B, less oxygen is supplied to the fixing position than in the state illustrated in FIG. 6A. Accordingly, even in the case where the continuous paper P at the fixing position catches fire, the fire is prevented from spreading.

In Step S12, the controller 11 maintains the fixing device 13 in the first state to be on standby while the controller 11 receives no command for forming an image from a user (NO in Step S12). In Step S14, if the controller 11 does not receive any command to perform switching to the second state via the UI section 14 (NO in Step S14), the controller 11 maintains the fixing device 13 in the first state and finishes the process.

If the continuous paper P is jammed and stopped from being transported while the image forming apparatus 10 is performing an image forming operation, even if the fixing device 13 stops emitting the laser beams or takes other measures, part of the continuous paper P remaining at the fixing position may catch fire due to laser beams that were previously emitted. On the other hand, even in the case where the continuous paper P catches fire in the image forming apparatus 10 according to the first exemplary embodiment described above, the fire does not spread since the housing 130 of the fixing member 13A covers the continuous paper P at the fixing position and oxygen is blocked from flowing to the fixing position. According to the first exemplary embodiment, the emitting member 131 housed in the housing 130 of the fixing member 13A is supported above the member 130*c*. Thus, even in the case where the continuous paper P catches fire, the emitting member 131 and the continuous paper P are located in different spaces that are separated from each other by the member 130*c* when the fixing device 13 is in the second state, and thus the emitting member 131 is protected from the fire. Since the position of the housing 130 that houses the emitting member 131 is not changed when the state of the fixing device 13 is switched to the second state, the position of the housing 130 does not have to be adjusted after the state of the fixing device 13 is switched back to the first state from the second state.

Second Exemplary Embodiment

The first exemplary embodiment is described by taking the case, as an example, where the moving mechanism 13B is disposed on the back surface side of the continuous paper P at a position at which overlaps the fixing position and the plate-like member 133 disposed on the back surface side of the continuous paper P is moved toward the fixing member 13A to thus block oxygen from flowing to the fixing position. In the second exemplary embodiment, a description will be mostly given of part of the configuration that is different from that of the first exemplary embodiment, i.e., in terms that a moving mechanism is disposed on a side of a housing that houses the emitting member 131.

Figure 7A:
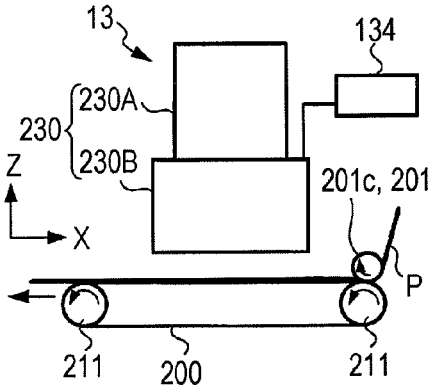
FIGS. 7A and 7B illustrate the first state of a fixing device according to a second exemplary embodiment.
Figure 7B:
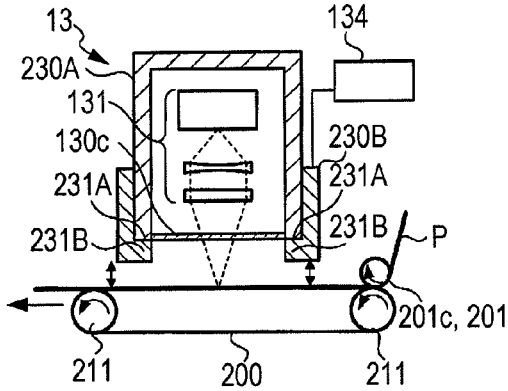

FIG. 7A is a schematic diagram illustrating an external view of a fixing device 13 according to the second exemplary embodiment seen in the Y axis direction of FIG. 2. FIG. 7B is a schematic sectional view of the fixing device 13 illustrated in FIG. 7A. In FIGS. 7A and 7B, components that are the same as in the first exemplary embodiment are denoted by the same reference numerals that are used in the first exemplary embodiment. Unlike in the case of the first exemplary embodiment described above, in the second exemplary embodiment, a transport belt 200 made of a fire-resistant material or the like is provided on a transport path of the continuous paper P in the fixing device 13. Transport rollers 211 are driven to rotate by the rotation of the rollers 201 in the arrow direction illustrated in FIGS. 7A and 7B, and thus the continuous paper P on the transport belt 200 is transported in the negative X axis direction. As illustrated in FIGS. 7A and 7B, the fixing device 13 includes a housing 230 that includes a first housing 230A and a second housing 230B. The first housing 230A has a configuration that is similar to that of the upper housing 130*a* according to the first exemplary embodiment. The second housing 230B covers the outer side of the first housing 230A. Emitting members 131, which emit laser beams to the surface of the transported continuous paper P, are supported inside the first housing 230A above a member 130*c* that allows the laser beams to pass therethrough.

The second housing 230B is an example of a second housing according to the invention. The second housing 230B is made of a material such as a metal and is connected to a driving section 134 that vertically moves the second housing 230B. The second housing 230B is supported by the driving section 134 such that the inner peripheral surface of the second housing 230B is movable over the outer peripheral surface of the first housing 230A. The second housing 230B has a projecting portion 231B that projects from a side of the second housing 230B facing the outer peripheral surface of the first housing 230A to the interior of the second housing 230B. When a fixing process is performed, the second housing 230B is supported at such a position that a lower end portion 231A of the first housing 230A and the projecting portion 231B of the second housing 230B come into contact with each other (hereinafter referred to as the default position). The driving section 134 has a configuration that is similar to that of the first exemplary embodiment described above. For example, the driving section 134 includes a motor such as a stepping motor and a ball screw. An upper surface portion of the second housing 230B is connected to a nut of the ball screw. When the ball screw is rotated by driving the stepping motor, the second housing 230B moves over the outer peripheral surface of the first housing 230A from the default position to a transport position of the continuous paper P. The driving section 134 may have a configuration in which a motor and an eccentric cam are used, or may be an electronic actuator or the like.

The fixing device 13 and the controller 11 according to the exemplary embodiment cooperatively function as a fixing device according to the invention. The fixing controller 301, the first housing 230A, and the emitting member 131 cooperatively function as a fixing unit according to the invention. The movement controller 302 and the driving section 134 cooperatively function as a switching unit according to the invention.

Figure 8A:
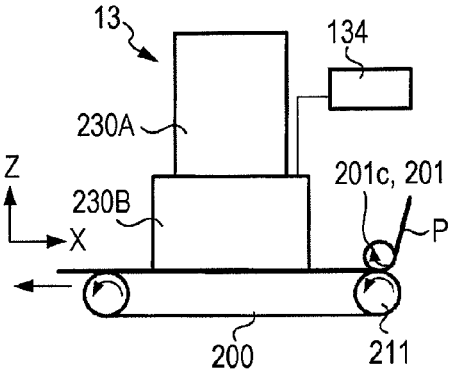
FIGS. 8A and 8B illustrate the second state of the fixing device according to the second exemplary embodiment.
Figure 8B:
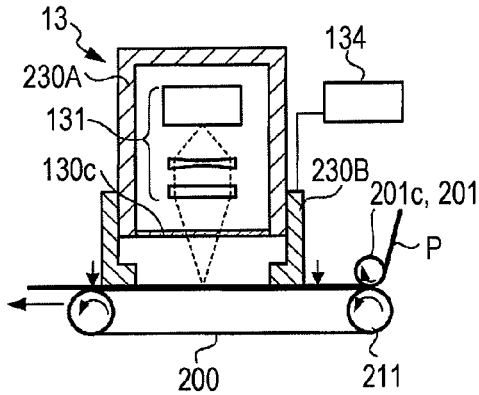

When the second housing 230B is moved from the default position in the first state as illustrated in FIGS. 7A and 7B to the transport position of the continuous paper P, the fixing device 13 is switched to the second state in which the continuous paper P at the fixing position is nipped by the transport belt 200 and the housing 230 and is thus covered with the housing 230, as illustrated in FIGS. 8A and 8B. When the controller 11 receives a command to perform switching to the second state from a user via the UI section 14, the controller 11 sends the fixing device 13 a signal indicating the second state. Thus, the fixing device 13 moves the second housing 230B so as to be switched from the first state to the second state. When the fixing device 13 is switched to the second state, the continuous paper P at the fixing position is covered with the housing 230 of the fixing device 13, as illustrated in FIG. 8B. Thus, less oxygen flows to the fixing position than in the case where the fixing device 13 is in the first state illustrated in FIG. 7B. Accordingly, even in the case where the continuous paper P catches fire in the image forming apparatus 10, the fire is prevented from spreading more efficiently than in the case of the fixing device 13 in which the continuous paper P at the fixing position is not covered with the housing 230 of the fixing device 13.

Modification

Although the exemplary embodiments of the invention have been described, the invention is not limited to the exemplary embodiments described above and may be embodied in various different modes. For example, the invention may be embodied by modifying the above-described exemplary embodiments in the following manner, or the exemplary embodiments may be combined. Modifications of the invention will be described hereinbelow.

Figure 9:
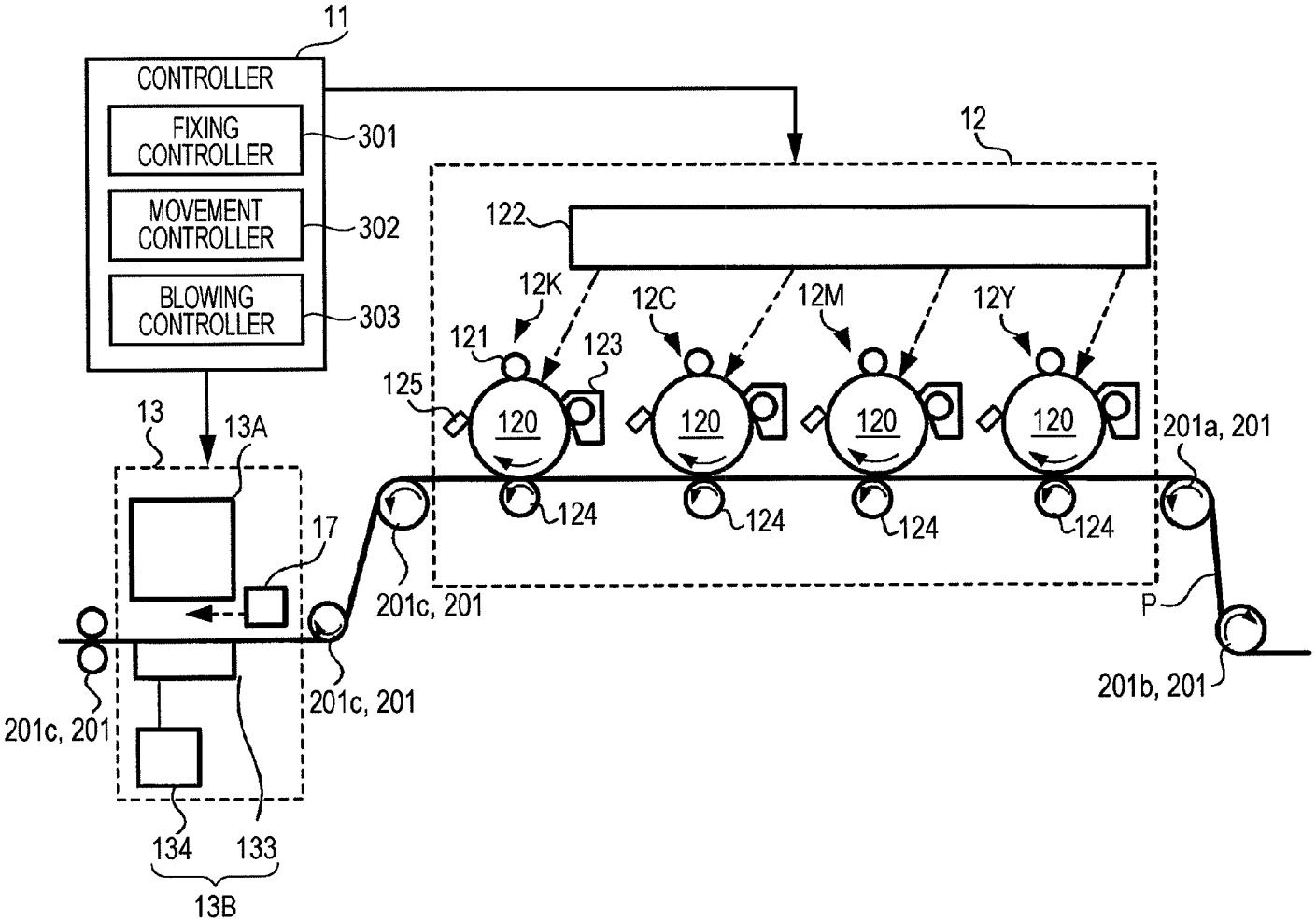
FIG. 9 is a schematic diagram illustrating a configuration of an image forming apparatus according to a first modification.

(1) The image forming apparatus 10 according to the first and second exemplary embodiments described above may include a blowing unit that blows a gas toward the fixing position to remove smoke generated when toner melts at the fixing position. The blowing unit may be driven when the fixing device is in the first state and may be stopped when the fixing device is switched to the second state. FIG. 9 illustrates such a configuration as described above. FIG. 9 illustrates a configuration in which a fan 17 is additionally provided to the image forming apparatus 10 according to the first exemplary embodiment, as an example of the blowing unit. In this case, the controller 11 includes a blowing controller 303 that controls driving of the fan 17. The blowing controller 303 is an example of a stopping unit according to the invention. The blowing controller 303 drives the fan 17 when the fixing device 13 is in the first state, and stops the fan 17 when the fixing device 13 is switched to the second state. By stopping the fan 17, less oxygen flows to the fixing position than in the case where the fan 17 is not stopped, and thus the fire burning the continuous paper P is less likely to spread. Furthermore, the fixing device 13 may be equipped with an extinguishing mechanism that blows an inert gas, such as nitrogen gas, to the fixing position to extinguish the fire. The fixing device 13 may stop the fan 17 and blow an inert gas to the fixing position by using the extinguishing mechanism when the fixing device 13 is switched to the second state.

Figure 10:
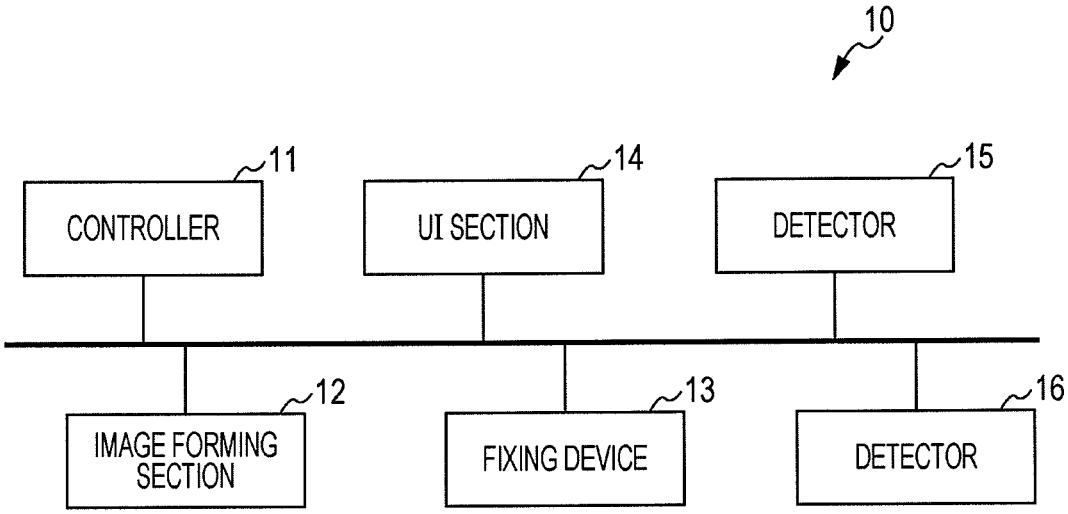
FIG. 10 is a block diagram illustrating a configuration of an image forming apparatus according to a second modification.

(2) In the first and second exemplary embodiments, the case is described, as an example, where the switching from the first state to the second state is performed when a user gives an instruction to perform switching to the second state. For example, as illustrated in FIG. 10, the image forming apparatus 10 may include at least one of a detector 15 that detects the occurrence of a paper jam in the image forming apparatus 10, and a detector 16 that detects the occurrence of a fire in either the image forming apparatus 10 or the fixing device 13. Here, the detectors 15 and 16 are taken as examples of a detecting unit according to the invention. When the occurrence of a paper jam or fire is detected, the fixing device 13 may be switched from the first state to the second state. The detector 16 may detect the occurrence of a fire when sensing a predetermined amount of smoke by use of, for example, a photoelectric smoke sensor. Instead, the detector 16 may detect the occurrence of a fire when sensing a predetermined temperature by use of a temperature sensor. Alternatively, the detector 16 may detect whether or not a laser beam has reached the back surface side of the continuous paper P and determines that a fire has occurred if the laser beam has reached the back surface side of the continuous paper P. Switching the fixing device 13 from the first state to the second state only when the occurrence of a fire is detected in the fixing device 13 is more efficient in preventing the fire from expanding than switching from the first state to the second state every time the occurrence of a paper jam is detected.

(3) In the second exemplary embodiment described above, the case is described, as an example, in which the second housing 230B of the fixing device 13 is moved toward the continuous paper P and thus the continuous paper P at the fixing position is covered with the housing 230 of the fixing device 13. However, another configuration may be employed in which no second housing 230B is provided, the first housing 230A is connected to the driving section 134 and moved toward the continuous paper P, and thus the first housing 230A covers the continuous paper P.

(4) In the first exemplary embodiment described above, the case is described, as an example, in which a transport belt that transports a recording medium is not provided. However, the continuous paper may be transported on the transport belt. In this case, the plate-like member 133 according to the first exemplary embodiment is disposed on the back surface side of the transport belt on which the recording medium is transported. A recording medium to be transported may be a recording medium other than continuous paper, such as a cut sheet that is cut in advance into an appropriate size.

(5) In the first and second exemplary embodiments described above, the case is described, as an example, in which each of the upper housing 130*a* and the first housing 230A has the member 130*c* with which the inside of the corresponding one of the upper housing 130*a* and the first housing 230A is partitioned, and a recording medium and the emitting member 131 are positioned in the spaces partitioned by the member 130*c* in the second state. However, each of the upper housing 130*a* and the first housing 230A may have no member 130*c*, but have an open lower end portion instead. In this case, the recording medium and the emitting member 131 are housed in a common space of the corresponding one of the housings 130 and 230 in the second state.

(6) In the first and second exemplary embodiments described above, a fixing device that fixes a toner image onto a recording medium by emitting laser beams to the toner image is described as an example. Alternatively, a fixing device that fixes a toner image to a recording medium by emitting light to the recording medium from a flash lamp that emits a flash may be employed.

(7) In the first exemplary embodiment described above, a description is given of the plate-like member 133 that comes into contact with an entire part of the back surface of the continuous paper P at the fixing position. Alternatively, for example, a support member that supports four sides or two opposing sides of the back surface of the continuous paper P at the fixing position, and a driving section that moves the support member may be provided, and the support member may be moved toward the housing 130 when the controller 11 instructs switching to the second state. In short, as long as the amount of oxygen flowing to the fixing position in the second state is reduced compared to that in the first state, the continuous paper P does not have to be completely covered with the housing 130 after the continuous paper P is pressed against the housing 130 of the fixing member 13A in the second state.

(8) Each of the image forming sections according to the exemplary embodiments and the modifications described above may include so-called rotary developing devices in which multiple developing devices are arranged in a circumferential direction of a rotor, or may form a monochrome image.

(9) In the exemplary embodiments described above, a recording medium that is perforated in advance is taken as an example of the continuous paper. Instead, a recording medium that has no perforation and continues in the longitudinal direction may be employed. In this case, a cutting unit may be provided that cuts the continuous paper after the fixing device performs a fixing operation on the continuous paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a fixing unit comprising:

an emitting unit configured to emit light; and a housing that houses the emitting unit, wherein the fixing unit is configured to fix a toner image to a recording medium by emitting the light to a surface of the recording medium and thereby form the toner image on the recording medium which has been transported to a fixing position that is away from the housing; and a switching unit configured to switch a state of the fixing device from a first state in which the housing and the recording medium are positioned away from each other to a second state in which the surface of the recording medium at the fixing position is in contact with the housing.

2. The fixing device according to claim 1, wherein the housing includes a partition member with which an interior of the housing is partitioned, and wherein the emitting unit in the housing and the recording medium are located in separate spaces that are partitioned by the partition member in the second state.

3. The fixing device according to claim 2, further comprising:

a movable member that is disposed on a back surface side of the recording medium and is configured to move toward the housing, wherein, in the first state, the switching unit holds the movable member on the back surface side of the recording medium, and in the second state, the switching unit moves the movable member to a position at which the recording medium at the fixing position is sealed with the housing.

4. The fixing device according to claim 3, further comprising:

a blowing unit configured to blow a gas to the fixing position; and a stopping unit configured to stop the blowing unit in response to the switching unit switching the state of the fixing device from the first state to the second state.

5. The fixing device according to claim 2, wherein the housing includes a first housing that houses the emitting unit and a second housing that is configured to move to the recording medium, and wherein, in the first state, the switching unit holds the first housing and the second housing at positions that are away from the recording medium, and in the second state, the switching unit moves the second housing to a position at which the recording medium at the fixing position is sealed with the first housing and the second housing.

6. The fixing device according to claim 5, further comprising:

a blowing unit configured to blow a gas to the fixing position; and a stopping unit configured to stop the blowing unit in response to the switching unit switching the state of the fixing device from the first state to the second state.

7. The fixing device according to claim 2, further comprising:

a blowing unit configured to blow a gas to the fixing position; and a stopping unit configured to stop the blowing unit in response to the switching unit switching the state of the fixing device from the first state to the second state.

8. The fixing device according to claim 1, further comprising:

a movable member that is disposed on a back surface side of the recording medium and is configured to move toward the housing, wherein, in the first state, the switching unit holds the movable member on the back surface side of the recording medium, and in the second state, the switching unit moves the movable member to a position at which the recording medium at the fixing position is sealed with the housing.

9. The fixing device according to claim 8, further comprising:

a blowing unit configured to blow a gas to the fixing position; and a stopping unit configured to stop the blowing unit in response to the switching unit switching the state of the fixing device from the first state to the second state.

10. The fixing device according to claim 1, wherein the housing includes a first housing that houses the emitting unit and a second housing that is configured to move to the recording medium, and wherein, in the first state, the switching unit holds the first housing and the second housing at positions that are away from the recording medium, and in the second state, the switching unit moves the second housing to a position at which the recording medium at the fixing position is sealed with the first housing and the second housing.

11. The fixing device according to claim 10, further comprising:

a blowing unit configured to blow a gas to the fixing position; and a stopping unit configured to stop the blowing unit in response to the switching unit switching the state of the fixing device from the first state to the second state.

12. The fixing device according to claim 1, further comprising:

a blowing unit configured to blow a gas to the fixing position; and a stopping unit configured to stop the blowing unit in response to the switching unit switching the state of the fixing device from the first state to the second state.

13. The fixing device according to claim 1, further comprising:

a detecting unit configured to detect whether the recording medium has caught fire, wherein the switching unit switches the state of the fixing device from the first state to the second state in response to the detecting unit detecting that the recording medium has caught fire.

14. An image forming apparatus comprising:

an image forming unit configured to form a toner image based on image data on a recording medium; and the fixing device according to claim 1.

15. The fixing device according to claim 1, wherein, in the second state, the surface of the recording medium at the fixing position is sealed with the housing.

16. The fixing device according to claim 15, wherein, in the second state, the surface of the recording medium at the fixing position is hermetically sealed with the housing.

17. The fixing device according to claim 1, wherein, in the second state, the recording medium at the fixing position is nipped between the housing and a plate member.

18. The fixing device according to claim 1, further comprising:

a detecting unit configured to detect whether the recording medium has jammed, wherein the switching unit switches the state of the fixing device from the first state to the second state in response to the detecting unit detecting that the recording medium has jammed.

19. A method for controlling a fixing device comprising a fixing unit for fixing a toner image to a surface of a recording medium which has been transported to a fixing position, wherein the fixing unit comprises a housing, the method comprising:

switching the fixing device from a first state in which the housing and the recording medium are positioned away from each other to a second state in which the surface of the recording medium at the fixing position is in contact with the housing.

20. A fixing device comprising:

a fixing unit comprising a housing, wherein the fixing unit is configured to fix a toner image to a surface of a recording medium which has been transported to a fixing position; and a switching unit configured to switch the fixing device from a first state in which the housing and the recording medium are positioned away from each other to a second state in which the surface of the recording medium at the fixing position is in contact with the housing.

* * * * *